United States Patent [19]

Hartmann

[11] 4,192,470

[45] Mar. 11, 1980

[54] CUTTING DEVICE FOR THE SHREDDING OF FOODSTUFFS SUCH AS ONIONS, VEGETABLES AND FRUITS

[75] Inventor: Horst Hartmann, Stuttgart, Fed. Rep. of Germany

[73] Assignee: Zyliss Zysset AG, Switzerland

[21] Appl. No.: 870,449

[22] Filed: Jan. 18, 1978

[30] Foreign Application Priority Data

Jan. 26, 1977 [DE] Fed. Rep. of Germany ... 7702152[U]

[51] Int. Cl.[2] ..... B02C 18/04

[52] U.S. Cl. ..... 241/169; 241/272

[58] Field of Search ..... 241/168, 169, 169.1, 241/169.2, 270, 272, 100, 285 A, 285 B, 283, 79; 366/244, 245, 246, 247, 248, 249, 250, 251, 252, 253, 254, 255; 83/859, 860

[56] References Cited

U.S. PATENT DOCUMENTS

| | | | |
|---|---|---|---|
| 2,140,010 | 12/1938 | Hanel | 241/272 |
| 2,787,308 | 4/1957 | Popeil | 241/272 |
| 3,029,851 | 4/1962 | Zysset | 241/272 |
| 3,933,315 | 1/1976 | Popeil | 241/272 X |

*Primary Examiner*—Gary L. Smith
*Assistant Examiner*—Robert P. Olszewski

[57] ABSTRACT

A cutting device for foodstuffs in which a container is provided with a cutter carried at the end of a spring biased plunger. The plunger is carried in a guide, formed separately of the container, as a member of a bell-shaped two part foldable housing, which is adapted to seat on the container. The plane of division of the two part housing being in the direction of movement of the cutter members.

19 Claims, 5 Drawing Figures

CUTTING DEVICE FOR THE SHREDDING OF FOODSTUFFS SUCH AS ONIONS, VEGETABLES AND FRUITS

BACKGROUND OF THE INVENTION

The present invention relates to a food cutting device for the shredding of foodstuffs such as onions, vegetables and fruits, having cutter means movable in a bell-shaped food housing by a manually operable plunger which is both axially and oscillatory reciprocable.

Cutting devices such as these are known, e.g., from Swiss Pat. No. 313,138 and German utility Pat. No. 76 17 234, wherein the plunger is held in guide component having an internal turning element coupled with the plunger via a looped-spring coupling. This type of turning device serves to oscillate the cutter means with each action up and down of the plunger through a preset angle.

In the known cutting devices the plunger has a stem or ram movable in a guide component which is integral with the bell housing, in which the cutter blade works on the food. Such conventional cutting-device design complicates access to the cutter means as well as to the turning element, which poses a major drawback for cleaning.

An object of the present invention is to improve the cutting device of the initially indicated type so that access to the cutter means and to the cleaning of the same is substantially facilitated, without impairing the plunger guidance in its oscillatory means with or without the use of a turning device.

SUMMARY OF THE PRESENT INVENTION

This problem is solved according to the invention by forming plunger assembly separate from the bell-shaped food housing and by forming the bell shaped housing in at least two sections divided along a plane which passes through the direction of movement of the plunger and the cutter means, the housing sections are positively force locked and/or lockable so that it can be closed in use and can be swung open and/or apart for cleaning. The plunger includes a ram, an outer sleeve, and with or without a turning device together with the cutter means so as to comprise a unit, secured in the neck of the multi-part separable bell housing in an easily detachable manner and/or to which the bell housing sections can be attached in a separable manner. With such swing apart bell housing sections completely free access to the interior of both housing and to the plunger mechanism is obtained so that they can be easily cleaned. This is particularly so if the bell housing sections are completely detachable from the separately formed plunger. Furthermore, a separation of the cutting device into plunger and sectioned bell housing is of advantage in the manufacture of these parts by synthetic-injection moulding processes, specifically if the cutter means are conventionally provided with turning devices of the indicated type.

The bell housing can consist of two identical half cylinder shells, having free bottom edges and which are hingedly locked to the outer sleeve of the plunger, and which are kept in the closed position by the use of a cup-shaped bottom member detachably secured to the lower edge of the shells. The linkage is so designed that the pivot axis of the hinge is set perpendicular to the direction of movement of the cutter means so that the half shells are diametrically opposed to each other relative to the plunger. Both half shells can then be swung open without any mutual obstruction to the extent of completely exposing the cutter means thus also facilitating the access to the plunger and its internally carried oscillating mechanism. The hinge may be formed of sets of bearing lugs formed on each of the half shells and on the plunger sleeve respectively and joined by a separable pivot or bearing. The bearing shafts can be omitted if one set of the bearing lugs are formed with bilaterally projecting bearing pins while the opposing set is formed with two open bearing seats, so that the pins can be swivelably hooked onto the projecting bearing seats. An added advantage of this is that both half shells can be easily detached from the plunger.

According to a further development, the plunger sleeve may be secured between a pair of collar members forming a shoulder in a positive locking manner, which collar members are integrally formed with their respective half shells forming the bell housing. The respective half shells and/or collar members are hingeably interconnected via a pivot axis which runs parallel with the ram direction, and which are kept in a snapped together position by suitable locking elements. The bell housing then can be easily attached about and detached from the plunger sleeve by means of this or other locking elements.

With this type of split bell housing an added guide or stripper for the cutter means can be removably located within the bell housing by forming in each of the housing half shells a horizontally disposed peripheral internal groove in which the guide could seat.

To interconnect both half shells so that they can be easily swung apart, each of the half shells can be equipped along the edge of the partition plane with mutually aligned hinge joints, which are pivotably interconnected by means of a bearing shaft. Both hinge joint parts are preferably integral with the mirror-image half shells, and radially project outward from the partition plane of the half shells.

Similarly, an interconnection of both of the collar members in which the oscillating mechanisms are accommodated can be made by the use of radial flanges extending from the center of the bell housing outwardly into integral connection with the hinge joint parts. A locking element may be used to secure each of the flanges together.

An interconnection of both half shells can also be obtained, by providing each of the half shells at their partition edges, opposite the hinge with mutually aligned cooperative locking elements, and by forming these locking elements integral with both half shells. In any case, the locking elements can be snaps, notch and detents, or bayonet type or the like. It is necessary only that the connection between the half shells be easily established and broken again without any tools and separate parts. For this purpose the most varied type of known locking elements may be used.

To insure operational condition of the half-shells comprising the bell housing, provision may be added for interconnecting the abutting half-shell joining edges by positive locking means. A positive lock in the split area can be obtained by providing the half-shell joining edges abutting on each other with mutually engaging and cooperating locking projections and detents which are interchangeably arranged along the edges.

To equip the cutting device with an oscillating mechanism, the plunger sleeve is formed as a cylindrical sleeve having helical guide grooves on its interior wall. A similarly shaped oscillatory element is concentrically set within the sleeve and is provided with projections slidable in the helical grooves. A manually actuable ram is slidingly extended through the oscillatory element and is coupled to it by a loop spring so that the oscillatory element is conjointly movable axially while relatively rotatable about it. On each downward actuation and upward resetting of the ram, the oscillatory element is carried over the entire movable distance of the ram within the sleeve, and is thereby simultaneously turned by a preset angle by action of the helical grooves.

The turning noise relative to known turning devices is reduced by anchoring a damping spring between the oscillatory element and plunger sleeve.

The design and assembly of the oscillating device can be kept simple by equipping the bottom of the oscillatory element with an extended internal shoulder for accommodating the looped spring, which is attached with one end of the oscillatory element.

To insure the lock-in of the oscillatory element on actuation and reset, provision is made for anchoring the top of the element against a limit stop secured to the ram and its bottom against a second limit stop, which is attached to the ram end being connected to cutter means.

BRIEF DESCRIPTION OF THE DRAWINGS

The invention is explained in more detail with reference to the drawings, where.

DESCRIPTION OF THE PRESENT INVENTION

Figure 1:
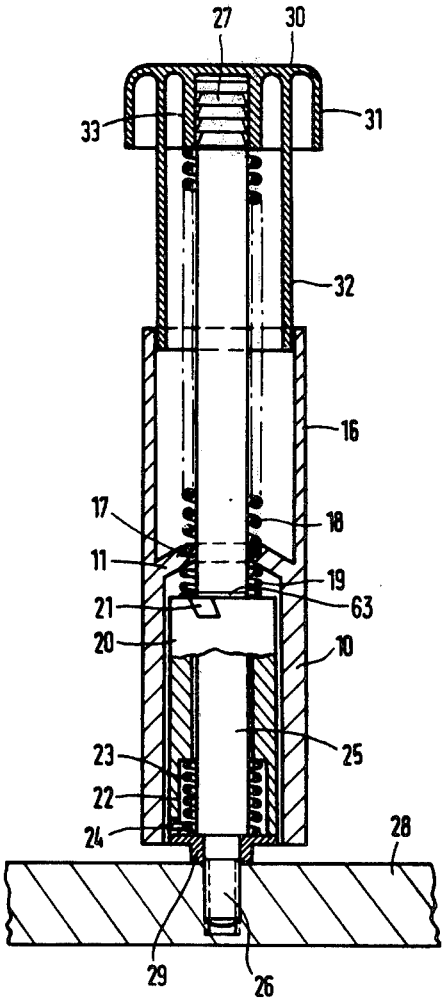
FIG. 1 is a longitudinal sectional view through the plunger and which is separable from the bell housing, which is not shown.
Figure 2:
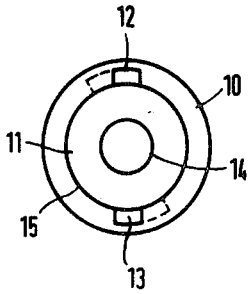
FIG. 2 is a bottom plan view of the plunger showing the sleeve and the oscillatory element.

A plunger embodying the principles of the present invention is illustrated in FIGS. 1 and 2 separately from the bell-shaped food housing of the known cutting device. The plunger comprises a guide or plunger sleeve 10 having a central sealed cover 11, which has a perforation 14 through which is received a ram 25. The internal wall 15 of the plunger sleeve 10 is formed with diametrically opposed helical grooves 12 and 13. A cylindrical oscillatory element 20 (e.g. sleeve) is slidably located within the sleeve concentric to the ram 25 and is provided with two projections 21 fitting in the grooves 12 and 13, respectively. Oscillatory element 20 is freely anchored at its top to the ram 25 by a collar 63 and rests with its bottom on a ring like stop member 29 which is also fixed to the ram 25 adjacent its lower end 26. The lower end 26 is fixedly connected to cutter means 28.

In this way, movement of the ram up and down causes the oscillatory element 20 to be forced along in axial alignment with the ram in the sleeve 10 while rotating, i.e. swinging reciprocably clockwise and counter-clockwise about the axis of the ram 25 due to its interaction with the helical grooves 12 and 13. On the bottom, the element 20 has an extended internal shoulder 22, which accommodates a looped spring 23, enveloping the ram 25, biasing the element against the nut. The spring 23 is attached with one end 24 to the turning element 20. Between the top of the oscillatory element 20 and the bottom of the central cover 11 is a damping spring 19, which intercepts and adequately damps the impact of the element 20 on upward movement of the ram 25. In this way, any impact noise is avoided.

The ram 25 projects through the hole 14 into a shell-like extension 16 joined to the sleeve 10, the extension 16 protectively covers a reset spring 18 slid over the length of the ram 25. At the upper end of the ram 25, a knoblike handle 30 is fixedly attached via an internal skirt 33 to the barb-like end 27 of the ram 25. The outer skirt 31 of the knob is knurled to improve manipulation. Joined to the knob is a central tube 32 smaller in diameter than the extension 16 and which extends right into the extension 16 so that the reset spring 18, which is anchored against the edge of the skirt 33 is completely covered and urges the ram 25 normally upward.

If the ram 25 is moved vertically downward by pushing on knob 30, then reset spring 18 is loaded, and looped spring 23 is relaxed by the turning of the oscillatory element 20, so that it lifts off from the ram 25. Therefore, ram 25 under the effect of actuating force can be axially moved downward without turning.

During the entire movement of the ram, the oscillatory element 20 is turned while being carried in guide sleeve, i.e., guiding projections 21 remain engaged over the whole distance of the guide grooves 12 and 13. After the downward stroke, if the ram 25 is released, then looped spring 23 tightens immediately and effects a coupling between the ram 25 and the oscillatory element 20 so that the latter is turned together with the cutter means 28 by the preset angle determined by the helix of the grooves 12 and 13.

The advantage of this new turning mechanism is that the element 20 is carried straight over the entire distance of its movement, and its reset is caught by the damping spring 19 without any impact noise. The resetting of the ram 25 by the plunger handle 30 is the function of reset spring 18, which is anchored against ring-like, flat limit stop 17 on the outside of the internal cover 11.

The sleeve 10 together with turning device 20 and the cutter means 28 comprises an easily assembled structural unit, which is connected and/or connectable to a split-bell housing wherein the partition line extends parallel to the direction of movement of the ram and, thus, the axis of the sleeve 10, and wherein a portion of the housing surrounds and holds the sleeve in the form of a connecting collar.

Figure 3:
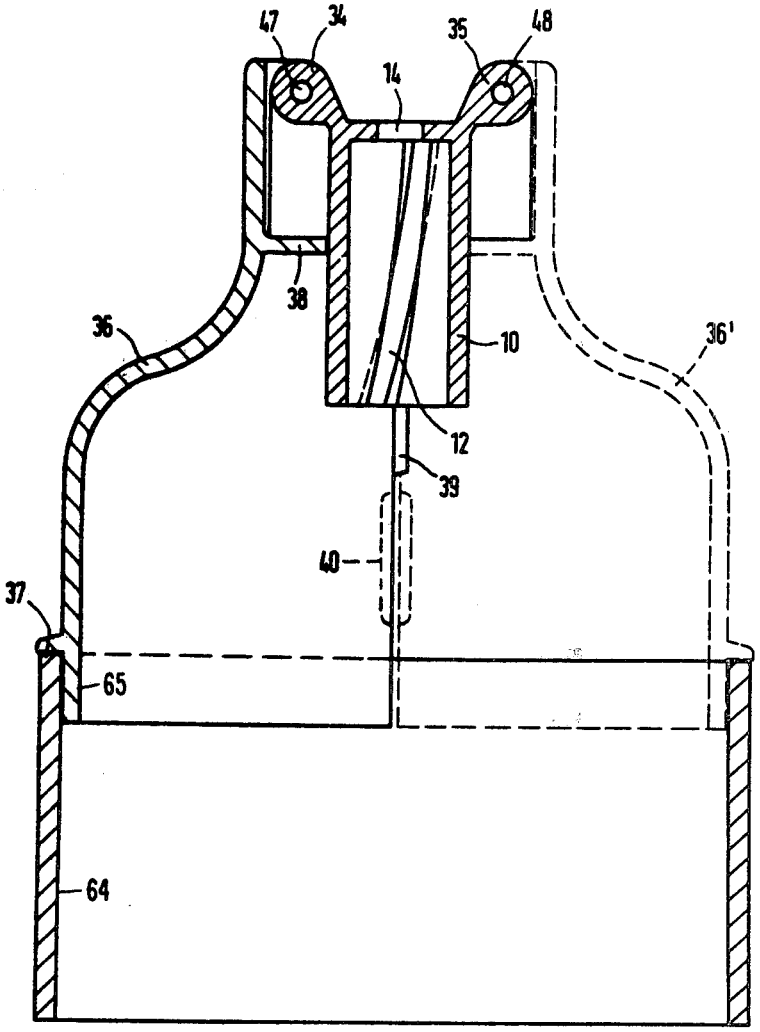
FIG. 3 is a longitudinal sectional view through another version of the present invention showing the plunger sleeve to which two bell-housing half shells are linked in a hingeable manner and fixed in an operating position by means of a locking cup.
Figure 4:
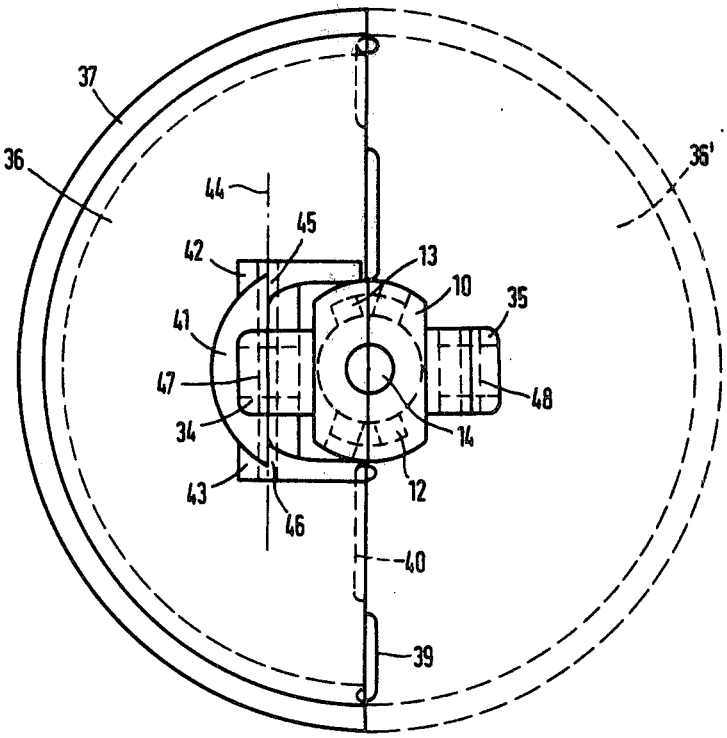
FIG. 4 is a top view of the bell-housing shown in FIG. 3.

To facilitate connection as well as access to the cutter means and turning device, which is of specific importance for cleaning, the bell housing may be of a split design as shown in FIGS. 3 and 4. In this case, the top of sleeve 10 is provided with two bearing lugs 34 and 35 having bearing holes 47 and 48. The bell housing is formed by two identical half shells 36 and 36', each of which is equipped at its top with an arcuate half collar 41 in which is formed a pair of opposed bearing lugs 42 and 43. These bearing lugs 42 and 43 are so arranged that they flank the associated bearing lugs 34 and 35 of sleeve 10, so that bearing holes 45 and 46 in both sets of these lugs 42 and 43 are aligned with bearing hole 47 and 48 formed in the associated bearing lug 34 and/or 35 of the sleeve 10 to accommodate a bearing shaft 44. Therfore, both half shells 36 and 36' are pivotably linked to the sleeve 10 via two parallel pivoting axes formed by the respective shafts 44 and may be folded upwardly with respect to the sleeve. Preferably, the link joints are set so far above on the collar 41 that on upward folding the half shells 36 and 36' do not obstruct each other or interfere with the sleeve 10.

Instead of having bearing lugs 34 and 35 the guide sleeve 10 can itself be provided with bilateral bearing pins projecting wing-like on opposite sides. Thus, by forming the bearing lugs 42 and 43 on their respective half-shells 36 and 36' of an open block type, then the pins can be hooked into the bearing wings so as to be freely swivelable on them. This linkage has the advantage that no separate bearing shafts are required and that for cleaning purposes the bell-housing half shells can be easily detached any time from the plunger sleeve 10.

Another notable fact is that half shells 36 and 36' may be easily kept in a folded operating position. For this purpose, a unitary locking cup 64 is provided, which simply is slid from below over the lower lip 65 of half shells 36 and 36'. The lip of the locking cup 64 is covered by a flange 37 extending peripherally about the outer surface of each of the half shells. In this overlapping area, the half shells 36 and 36' and locking cup 64 can be equipped with bayonet type lock elements so by relatively turning the slidable cup and the half shells 36 and 36' they can be secured and maintained in operating position.

The upper neck portions of the half shells 36 and 36' below the lugs 42 and 43 are provided with radially inward semicircular flanges 38 of a length sufficient to engage the periphery of the sleeve 10 and each other to form a continuous wall when the half shells are closed thereby gripping and holding the plunger sleeve 10 securely during operation and seal against the loss of food.

To tightly seal the composite half shells of the ball housing, provision is made for the positive interlocking of half-shells 36 and 36' along their vertical dividing edges. For this purpose, alternating projecting locking ridges 39 and recessed locking retainders 40 are provided, which are arranged in reverse sequence in the symmetrical joining edges of the respective half shells. Both half shells 36 and 36', therefore, can be identically formed which insures that the locking ridges 39 of one half shell engage the locking ridges 40 of the other half shell over the entire joining edge and vice versa.

If the locking cup 64 is removed then the half shells 36 and 36' can be upward-folded relative to the plunger sleeve 10 and/or removed so that cutter means 28 and the turning device can be made easily accessible and cleaned.

Figure 5:
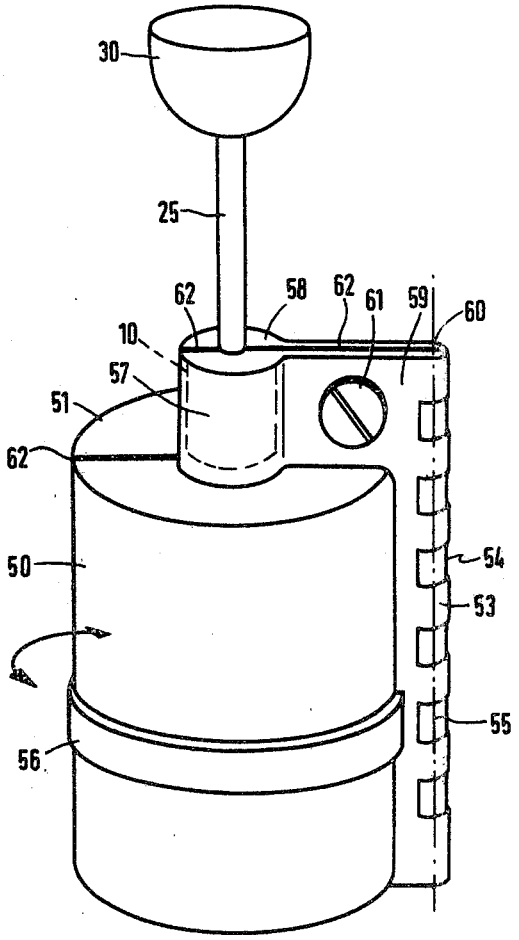
FIG. 5 is a lateral view of another embodiment of a cutting device according to the invention, where the half shells are hingeably interconnected at a vertical edge and accommodate and fix the plunger sleeve by way of integral collar retainers.

In FIG. 5, the bell-shaped housing is formed so that the plunger sleeve 10 is positively held within a collar formed by arcuate projections 57 and 58 formed on the upper surface of the half shells 50 and 51 which differ also from those of FIGS. 3 and 4 by having a bottom wall as well as a top wall. The ram 25 and its handle 30 project upwardly from shoulders 57 and 58. Both half shells 50 and 51 are a mirror image of each other and have matched hinges 53 and 54 extending radially outwardly connected by a shaft 55 lying parallel to the direction of the movement of the ram 25, so as to pivot about an axis 60 and form a vertical dividing plane 62. The hinge parts 53 and 54 are integrally formed to their respective half shells 50 and 51. The shaft 55 is removably inserted, which allows both half shells 50 and 51 to be disconnected.

The projections 57 and 58 forming the collars which hold the plunger sleeve are integral with the hinge members 53 and 54 respectively via horizontal web members 59 and 60 in which a locking element 61 is located. The locking element may be snap, screw, or bayonet type so that the parts may be easily assembled and disassembled. The vertical meeting edges of the half shells 50 and 51 may be made with interlocking projections and recess as aforementioned.

As seen in FIG. 5, the central portion of each of the half shells is formed with an internal peripheral groove 56 which can accommodate a cutter blade guide and food stripper of known design through which the cutter means passes on its up and down movement.

I claim:

1. A food chopper comprising a bell shaped housing having a cylindrical portion and a central neck portion, blade means locatable within the cylindrical portion of said housing and a plunger assembly extending through the neck of said housing comprising an axially movable ram attached at one end to said blade means, a handle at the other end, an outer sleeve surrounding a portion of said ram and means interposed between said sleeve and said ram for causing said ram to rotate about its axis on axial movement of said ram, said bell-shaped housing being formed of at least two separable sections divided along lines parallel to the axis of said ram and means for removably securing the outer sleeve to said housing sections, whereby said housing and said plunger assembly are separable.

2. The food chopper according to claim 1 wherein each of the sections of said housing are formed with a radially directed flange adjacent the neck portion thereof extending into contact with said outer sleeve and with each other to form a continuous wall thereabout.

3. The food chopper according to claim 1 wherein said housing sections have free bottom edges and said housing includes a cup removably secured to said free edges to enclose said housing.

4. The food chopper according to claim 1, wherein said housing sections are identical half shells and said means for removably securing said outer sleeve to said sections comprises cooperable hinge means formed on the outer surface of said sleeve and on said half shells adjacent the neck of said housing.

5. The food chopper according to claim 4, wherein the pivot axis of said hinge means extends perpendicularly to the axis of said ram.

6. The food chopper according to claim 5, wherein each of said hinge means comprises a pair of bearing lugs integrally formed on the surface of said outer sleeve, a pair of corresponding bearing lugs integrally formed on said respective housing rection and a pin extending through said bearing holes.

7. The food chopper according to claim 5, wherein each of said hinge means comprises a pair of bearing pins integrally formed on the exterior surface of said sleeve extending outwardly therefrom and a pair of corresponding bearing lugs integrally formed on the respective housing section for removably receiving said pins.

8. The food chopper according to claim 7 wherein said bearing lugs have open bearing seats permitting said pins to be hookably inserted therein.

9. The food chopper according to claim 1 wherein said housing sections comprises a pair of identical half shells and includes hinge means integral therewith joining said shells along one of said dividing lines and having a pivot axis parallel to the axis of said ram.

10. The food chopper according to claim 9, wherein each of said half shells is formed with an arcuate extension at its upper edge cooperating with each other to form a cylindrical collar receiving the outer sleeve of the plunger.

11. The food chopper according to claim 10 wherein said projections forming the collar are integral connected to said hinge member and include means for removable securing said hinge member in closed position.

12. The food chopper according to claim 10 wherein said half shells are formed with bottom walls, said half shells forming a completely closed bell-shaped housing.

13. The food chopper according to claim 11, wherein said hinge means extends radially from the peripheral surface of said half shells along the plance dividing said shells.

14. The food chopper according to claim 4, wherein the abutting edges of said half sections are provided with cooperately separable locking means.

15. The food chopper according to claim 10, wherein the abutting edges of said half sections are provided with cooperable separable locking means.

16. The food chopper according to claim 14, wherein said locking means are selected from the group consisting of snap fasteners, notch and detent fasteners and bayonet fasteners.

17. The food chopper according to claim 1, wherein the outer sleeve of said plunger is provided with at least one helical groove, and the means for causing the ram to oscillate comprises an oscillatory sleeve interposed between the outer sleeve and said ram having means projecting from the periphery thereof into said helical groove and spring means securing said oscillatory sleeve on said ram, actuable on downward movement of said ram to cause conjoint axial movement and relative oscillatory movement of said oscillatory sleeve relative to said ram and actuable on the upward movement of said ram to connect said oscillatory sleeve and ram for conjoint oscillating motion and axial movement.

18. The food chopper according to claim 17, including second spring means anchored between the oscillatory sleeve and the outer sleeve to damp the movement thereof.

19. The food chopper according to claim 17, wherein said oscillatory sleeve is provided with a concentric recess at one end and said spring means comprises a helical spring looped about said ram within said recess.

* * * * *